US010502205B2

(12) United States Patent
Wang

(10) Patent No.: US 10,502,205 B2
(45) Date of Patent: Dec. 10, 2019

(54) AIR PUMP DEVICE

(71) Applicant: BETO ENGINEERING AND MARKETING CO., LTD., Taichung (TW)

(72) Inventor: Lopin Wang, Taichung (TW)

(73) Assignee: BETO ENGINEERING AND MARKETING CO., LTD., Taichung (TW)

( * ) Notice: Subject to any disclaimer, the term of this patent is extended or adjusted under 35 U.S.C. 154(b) by 6 days.

(21) Appl. No.: 15/894,277

(22) Filed: Feb. 12, 2018

(65) Prior Publication Data

US 2019/0128255 A1 May 2, 2019

(30) Foreign Application Priority Data

Oct. 30, 2017 (TW) ..... 106137386 A

(51) Int. Cl.

| | |
|---|---|
| ***F16K 15/20*** | (2006.01) |
| ***F04B 49/22*** | (2006.01) |
| ***F04B 53/10*** | (2006.01) |
| ***F04B 37/12*** | (2006.01) |
| ***F04B 33/00*** | (2006.01) |
| ***F04B 39/10*** | (2006.01) |
| ***F04B 41/02*** | (2006.01) |

(52) U.S. Cl.

CPC ..... *F04B 49/225* (2013.01); *F04B 33/00* (2013.01); *F04B 37/12* (2013.01); *F04B 39/10* (2013.01); *F04B 41/02* (2013.01); *F04B 49/22* (2013.01); *F04B 53/10* (2013.01); *Y10T 137/3724* (2015.04)

(58) Field of Classification Search

CPC .. F04B 33/00; F04B 33/005; Y10T 137/3584; Y10T 137/3724

See application file for complete search history.

(56) References Cited

U.S. PATENT DOCUMENTS

| | | | | |
|---|---|---|---|---|
| 6,676,390 | B2 * | 1/2004 | Wang | F04B 33/00 417/468 |
| 8,721,296 | B1 * | 5/2014 | Wang | F04B 33/005 137/565.15 |
| 10,047,742 | B2 * | 8/2018 | Wang | F04B 53/10 |
| 2003/0192619 | A1 * | 10/2003 | Marui | F04B 33/005 141/40 |
| 2018/0119684 | A1 * | 5/2018 | Winefordner | F04B 33/00 |

FOREIGN PATENT DOCUMENTS

| | | |
|---|---|---|
| TW | I495788 B | 8/2015 |

* cited by examiner

*Primary Examiner* — Robert K Arundale
(74) *Attorney, Agent, or Firm* — Muncy, Geissler, Olds & Lowe, P.C.

(57) ABSTRACT

An air pump device includes an air generating mechanism, an air tube unit, an air cylinder, and a control mechanism. The air cylinder has an air-receiving space and an air channel being in fluid communication, and a valve unit. The control mechanism includes a manifold seat interconnecting a linking unit of the air generating mechanism and the air tube unit, and a control unit convertible between an air-storing position, where air advanced from the linking unit into the manifold seat is limited to flow into the air channel, and the valve unit is opened to allow entrance of the air into the air-receiving space, and an air-pumping position, where air advanced from the linking unit into the manifold seat is limited to flow into the air tube unit.

9 Claims, 16 Drawing Sheets

AIR PUMP DEVICE

CROSS-REFERENCE TO RELATED APPLICATION

This application claims priority of Taiwanese Patent Application No. 106137386, filed on Oct. 30, 2017.

FIELD

The disclosure relates to an air pump device, and more particularly to an air pump device that is capable of providing both high pressure gas and low pressure gas.

BACKGROUND

A conventional hand-operated air pump can be categorized into direct pumping type and air storage type. An air pump of direct pumping type operates by manually pumping air into an air chamber of the air pump, and the air flows into a to-be-inflated object via an air tube unit of the air pump. The air delivered into the object has a relatively low pressure, and thus this type of air pump is suitable for inflating balloons, low pressure tires, etc. On the contrary, an air pump of air storage type is configured with an air storage cylinder that stores high pressure gas, which can be delivered to an object to inflate the object. Since the two types of air pumps have different ways of air delivery and have different structures, a user has to purchase both types of the air pumps in order to fulfill needs of inflating objects that require high pressure gas and inflating objects that require low pressure gas.

The applicant of this disclosure designed a conventional air pump device which is disclosed in Taiwanese Patent No. 1495788 and which is capable of outputting low pressure gas and high pressure gas. The conventional air pump device is configured with an air generating mechanism and an air cylinder that are fixedly coupled to each other. However, the air generating mechanism and the air cylinder cannot be separated and cannot be individually operated.

SUMMARY

Therefore, an object of the disclosure is to provide an air pump device that can alleviate at least one of the drawbacks of the prior arts.

According to the disclosure, the air pump device includes an air generating mechanism, an air tube unit, an air cylinder, and a control mechanism.

The air generating mechanism includes an air generating unit and a linking unit connected to the air generating unit. The air cylinder includes a cylinder body and a valve unit. The cylinder body has an air-receiving space, and an air channel being in fluid communication with the air-receiving space. The valve unit is operable for opening and closing the air channel. The control mechanism includes a manifold seat and a control unit. The manifold seat interconnects the linking unit of the air generating mechanism and the air tube unit. The air cylinder is removably connected to the manifold seat. The control unit is mounted to the manifold seat, and is convertible between an air-storing position, where air advanced from the linking unit into the manifold seat is limited to flow into the air channel, and the valve unit is urged by pressure of the air to open so as to allow entrance of the air into the air-receiving space of the air cylinder, and an air-pumping position, where air advanced from the linking unit into the manifold seat is limited to flow into the air tube unit for output to inflate an object.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
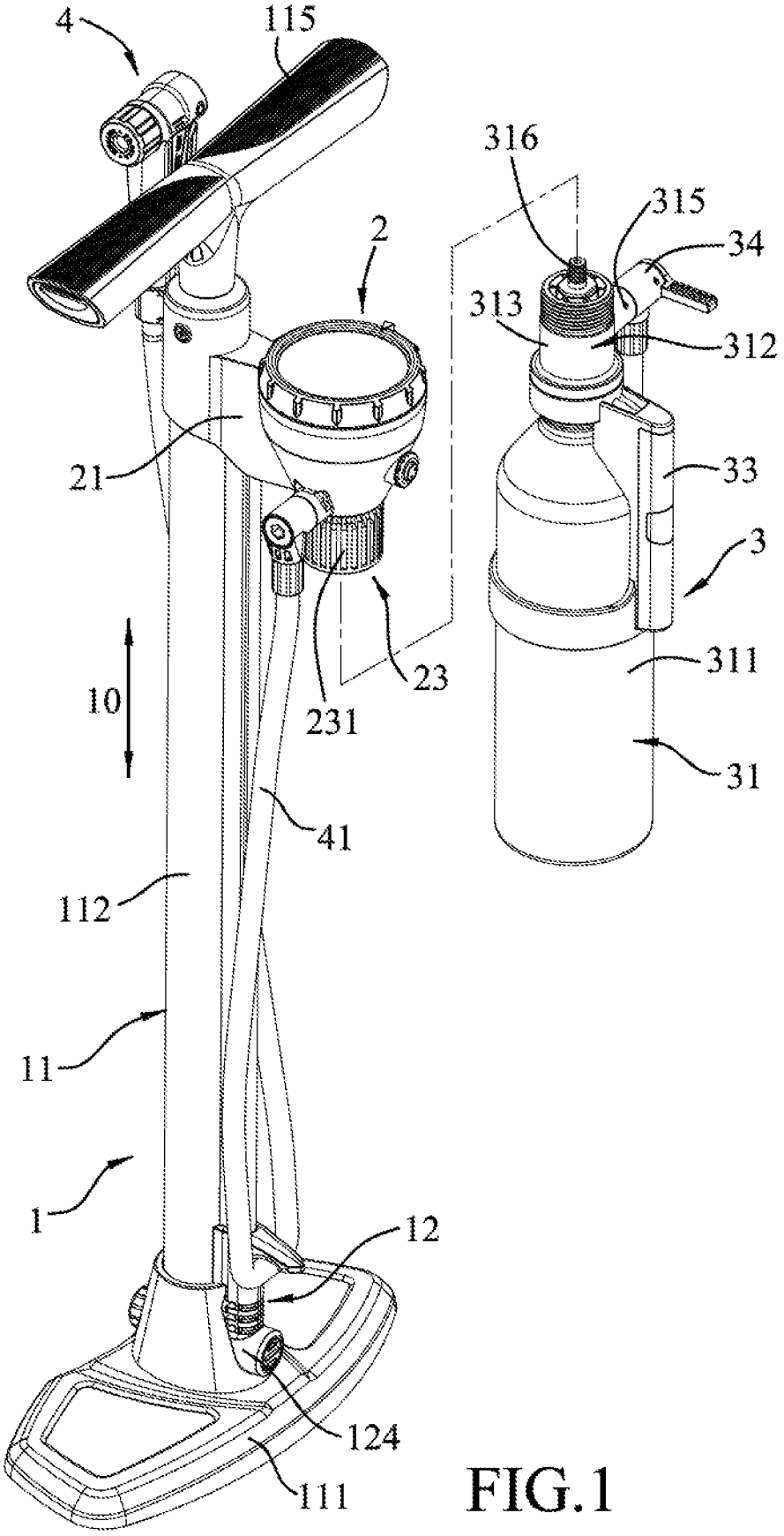
FIG. 1 is a partly exploded perspective view illustrating a first embodiment of an air pump device according to the disclosure.
Figure 2:
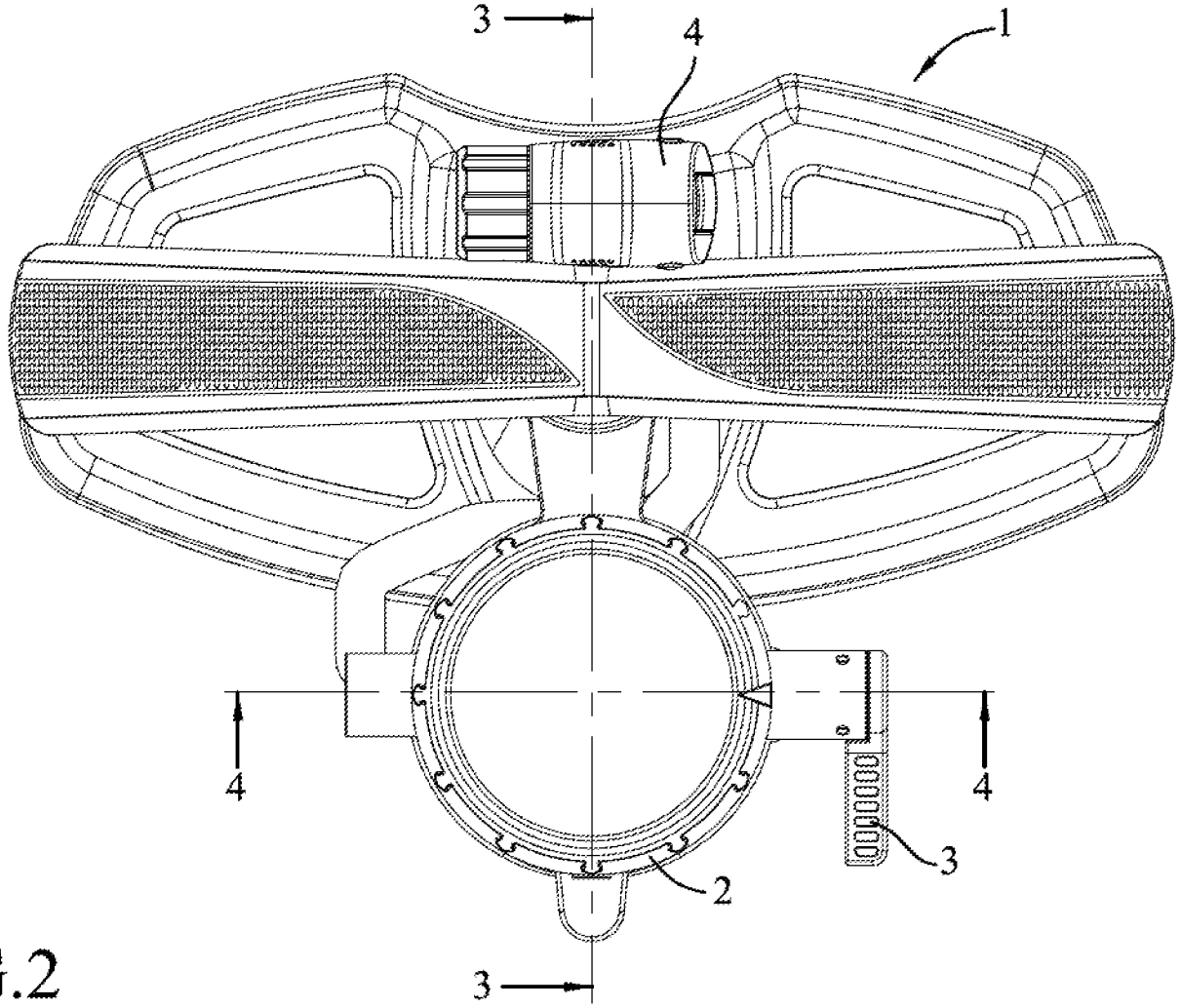
FIG. 2 is a top view of the first embodiment.
Figure 3:
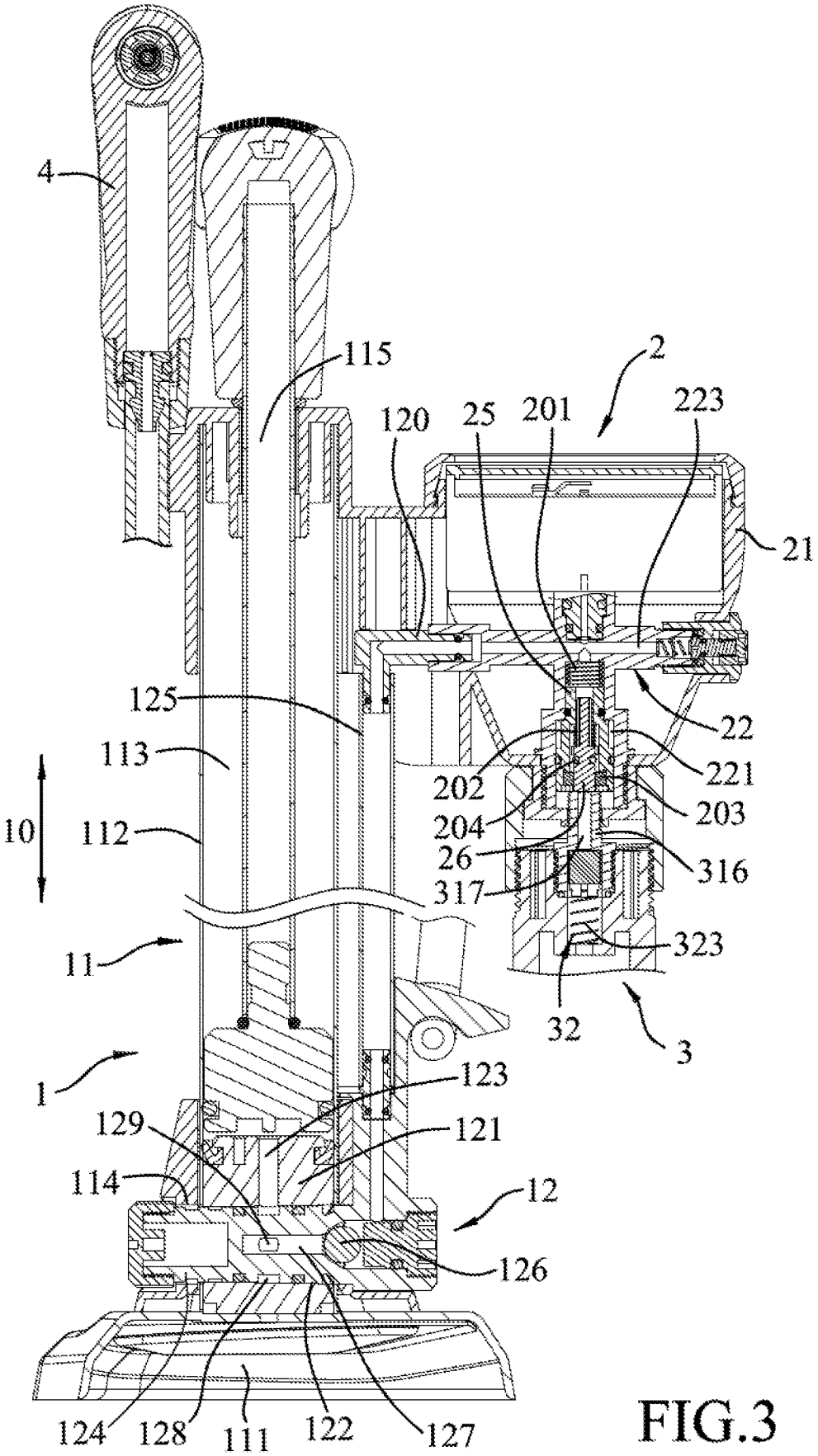
FIG. 3 is a fragmentary sectional view taken along line 3-3 in FIG. 2.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 4, a first embodiment of an air pump device according to the disclosure is capable of providing both high pressure gas and low pressure gas for inflation of an object (not shown). It should be noted that the usage of the terms "high pressure gas" and "low pressure gas" is relative, and does not impose a specific limit on the range of the gas pressure. The air pump device includes an air generating mechanism 1, a control mechanism 2 connected to the air generating mechanism 1 and disposed for controlling direction of air flow, an air cylinder 3 removably connected to and disposed under the control mechanism 2 for outputting high pressure gas, and an air tube unit 4 coupled to the control mechanism 2 for outputting low pressure gas.

The air generating mechanism 1 includes an air generating unit 11 and a linking unit 12 that is connected to the air generating unit 11. The air generating unit 11 has a bottom seat 111, a pump cylinder 112 connected to the bottom seat 111 and defining a vertical cylinder chamber 113, a mounting hole 114 extending between the bottom seat 111 and the pump cylinder 112 and fluidly communicating with the cylinder chamber 113, and a piston set 115 mounted to the pump cylinder 112 and movable along a piston-moving axis 10. Since the technique of using the piston set 115 to draw air into the cylinder chamber 113 is well known to those skilled in the art, further details will not be provided herein for the sake of brevity.

The linking unit 12 provides a one-way flow control, and includes a first valve seat 121, a second valve seat 124, an outlet tube 125, and a non-return member 126. The first valve seat 121 is disposed in the cylinder chamber 113 and is proximate to the bottom seat 111, and has an insert hole 122 that extends horizontally, and a communicating hole 123 that fluidly communicates the insert hole 122 and the cylinder chamber 113. The second valve seat 124 extends through the insert hole 122 and the mounting hole 114 of the air generating unit 11, and has two closed ends. The second valve seat 124 has an L-shaped valve channel 127, a recess 128 that is formed in an outer surface thereof and that corresponds in position to the communicating hole 123, and at least one valve hole 129 that fluidly communicates the recess 128 and the valve channel 127. The outlet tube 125 is disposed on a side of the pump cylinder 112, and has a bottom end that is connected to the second valve seat 124, and a linking portion 120 that extends horizontally and that is proximate to a top portion of the pump cylinder 112. The non-return member 126 is disposed in the second valve seat 124, and opens or closes the valve channel 127 depending on the direction of the air flow so that air in the outlet tube 125 is prevented from flowing back into the cylinder chamber 113.

Figure 4:
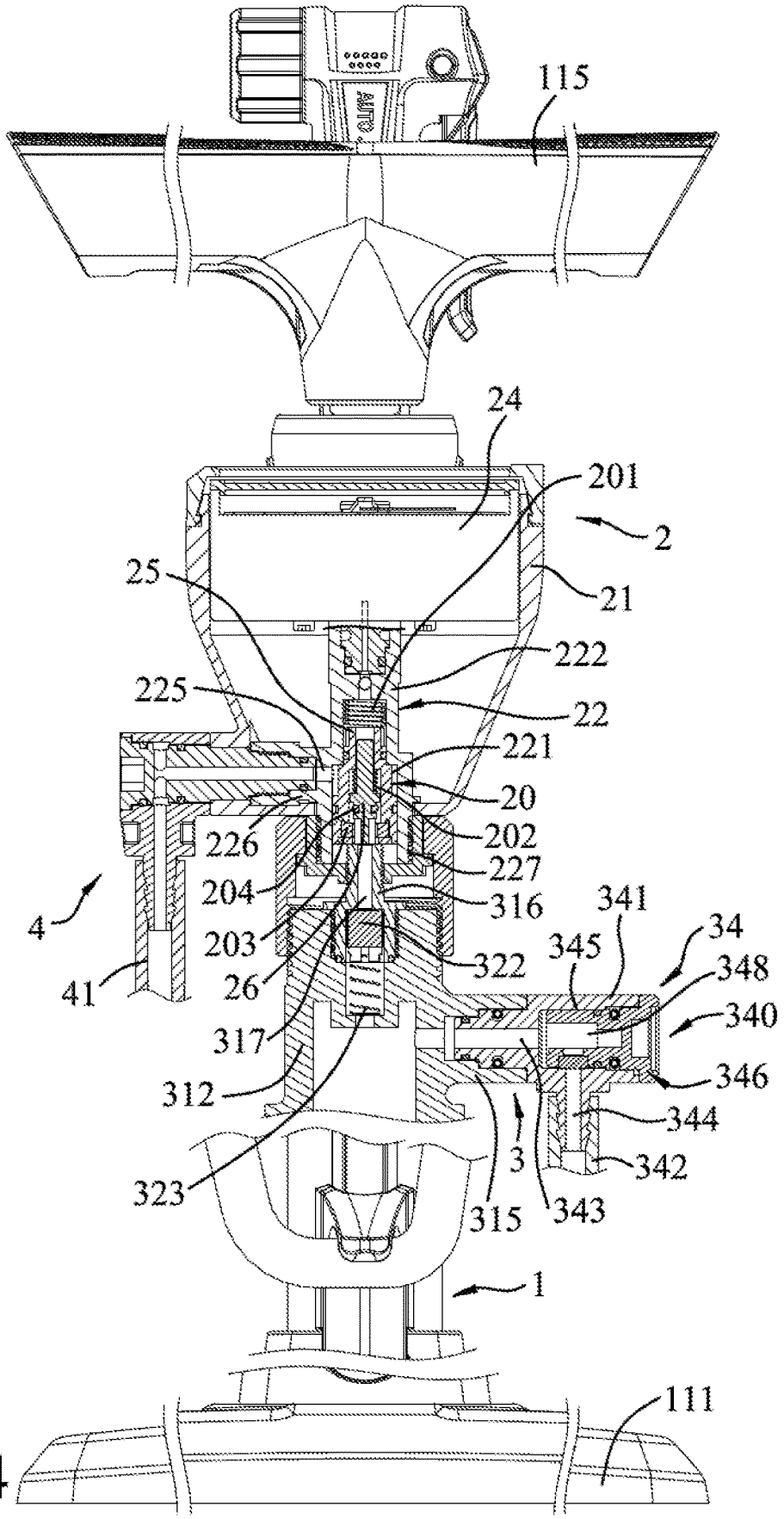
FIG. 4 is a fragmentary sectional view taken along line 4-4 in FIG. 2.
Figure 6:
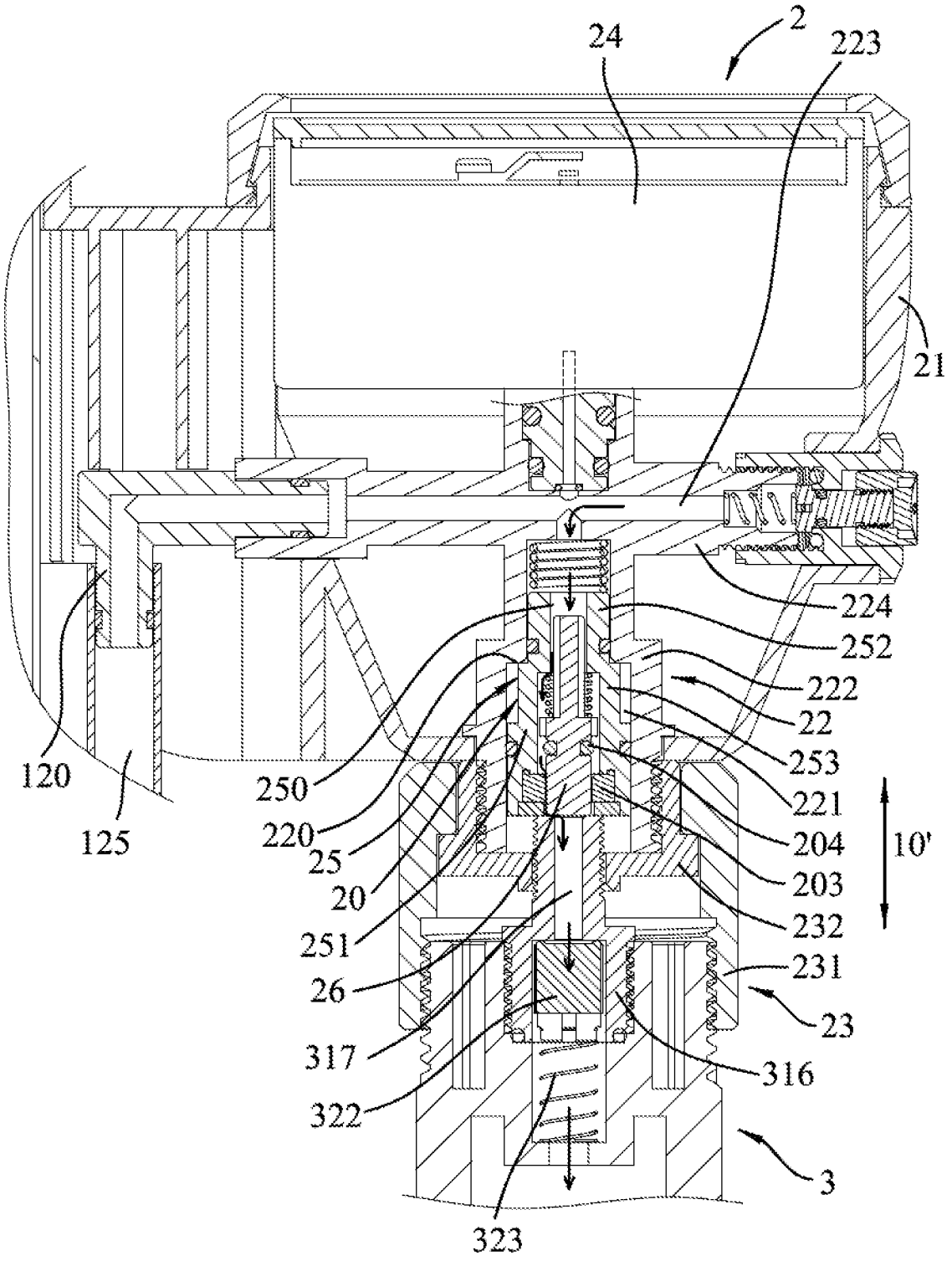
FIG. 6 is a fragmentary enlarged sectional view of the first embodiment, illustrating the direction of air flow when a control unit of the control mechanism is at an air-storing position.
Figure 7:
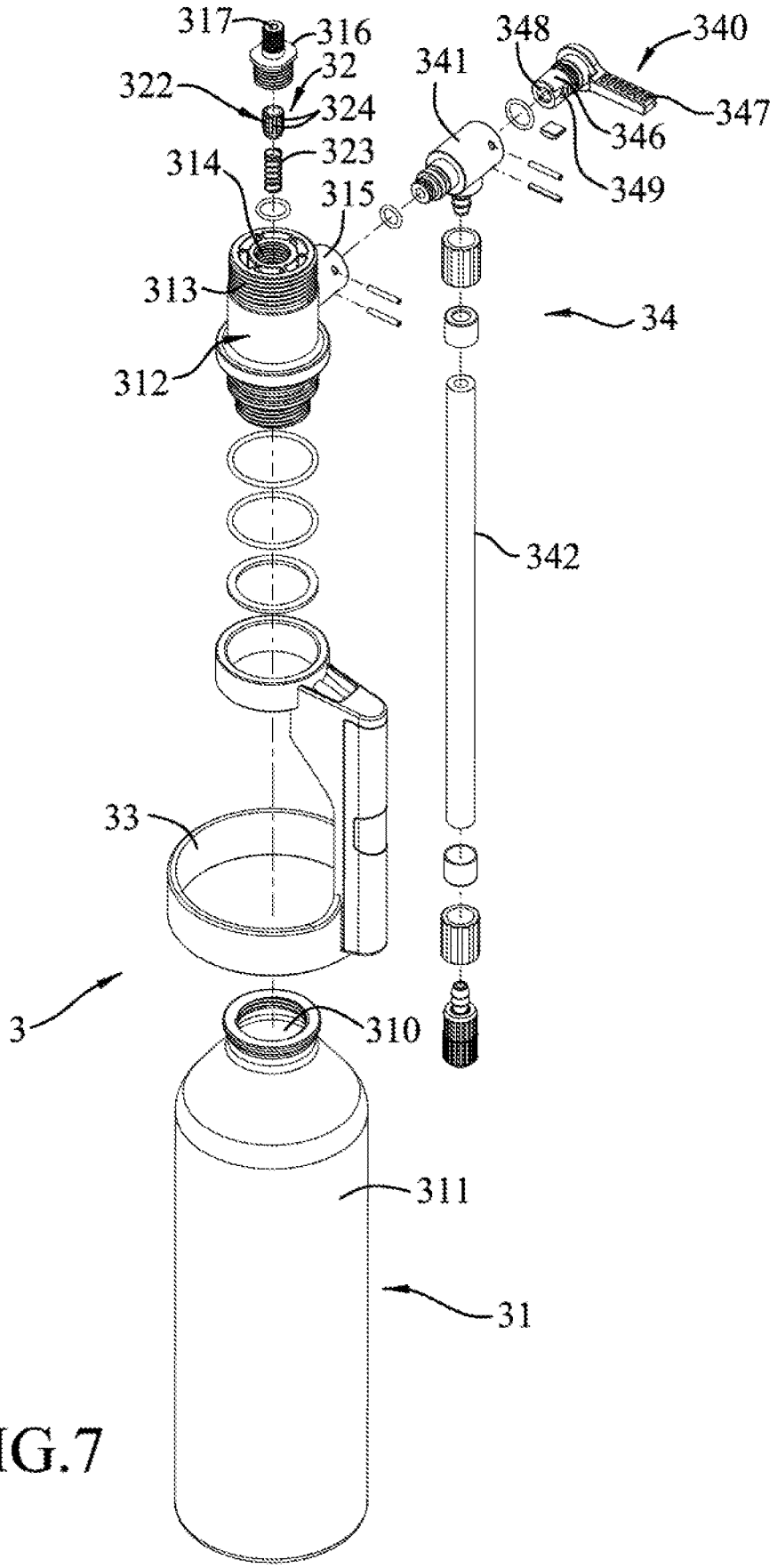
FIG. 7 is an exploded perspective view of the air cylinder of the first embodiment.

Referring to FIGS. 4, 6, and 7, the air cylinder 3 includes a cylinder body 31, a valve unit 32 disposed in the cylinder body 31, a handle 33 connected to the cylinder body 31 for easy handling, and an outputting unit 34 coupled to the cylinder body 31.

The cylinder body 31 has a container component 311, a head component 312, and a tip component 316. The container component 311 defines an air-receiving space 310. The head component 312 is connected to a top of the container component 311, and has a securing part 313, an extending hole 314 extending through the securing part 313, and a side tube 315 fluidly communicating with the air-receiving space 310. The tip component 316 is connected to the head component 312. More specifically, the tip component 316 is inserted downward into the extending hole 314, and has an air channel 317 being in fluid communication with the air-receiving space 310.

The valve unit 32 is operable for opening and closing the air channel 317. The valve unit 32 includes a valve member 322 that is disposed in the air channel 317 and that is movable along a valve-moving axis 10', and a biasing spring 323 that is disposed for biasing the valve member 322 upward to block the air channel 317. The valve member 322 has an outer surface formed with a plurality of spaced-apart external air vent passageways 324.

The outputting unit 34 includes an output valve seat 341 mounted to the side tube 315 of the head component 312 of the cylinder body 31, and an output tube 342 connected to the output valve seat 341. The output valve seat 341 has a first tube section 343 that fluidly communicates with the air-receiving space 310, a second tube section 344 that is transverse to the output tube 342, and a connecting chamber 345 that interconnects the first and second tube sections 343, 344. The outputting unit 34 further includes an operating member 340 having a hollow rod portion 346 that is rotatably disposed in the connecting chamber 345, and a handle portion 347 that protrudes outside of the connecting chamber 345 for easy access by a user. The hollow rod portion 346 of the operating member 340 defines an output channel 348 fluidly communicating with the first tube section 343 of the output valve seat 341, and is formed with a through hole 349 fluidly communicating with the output channel 348. The handle portion 347 of the operating member 340 can be rotated to a position where the through hole 349 is registered with the second tube section 344 of the output valve seat 341 to communicate the second tube section 344 with the first tube section 343. When the through hole 349 is not registered with the second tube section 344, the passage from the first tube section 343 to the second tube section 344 via the connecting chamber 345 is blocked.

Referring to FIGS. 3 to 6, the control mechanism 2 includes a base seat 21 that is connected to a top portion of the air generating mechanism 1, a manifold seat 22 that is disposed in the base seat 21, a coupling ring unit 23 that is disposed under the base seat 21 and that is connected to the manifold seat 22, a control unit 20 that is disposed in the manifold seat 22 and that is for controlling direction of the air flow, and a pressure gauge 24 that is disposed in the base seat 21 and that is connected to the manifold seat 22.

The manifold seat 22 interconnects the linking unit 12 of the air generating mechanism 1 and the air tube unit 4, and has the air cylinder 3 removably connected thereto. The manifold seat 22 has a main tube 222 that defines a main channel 221, a first manifold tube 224 that defines an inlet channel 223, a second manifold tube 226 that defines a tube-connecting channel 225. The inlet channel 223 is connected between the main channel 221 and the linking unit 12, and the tube-connecting channel 225 is connected between the main channel 221 and the air tube unit 4. More specifically, the inlet channel 223 has an end that is connected to the linking portion 120 of the outlet tube 125 of the linking unit 12, and an opposite end that is disposed at a side of the main channel 221 opposite to the linking portion 120 and that is closed. The main tube 222 has a coupling segment 227 that protrudes downwardly from a bottom of the base seat 21, a large diameter segment 228 that is connected to the coupling segment 227, a small diameter segment 229 that is connected to the large diameter segment 228 opposite to the coupling segment 227 and that is connected to the first manifold tube 224, and a shoulder 220 that is formed between the large diameter segment 228 and the small diameter segment 229.

Figure 5:
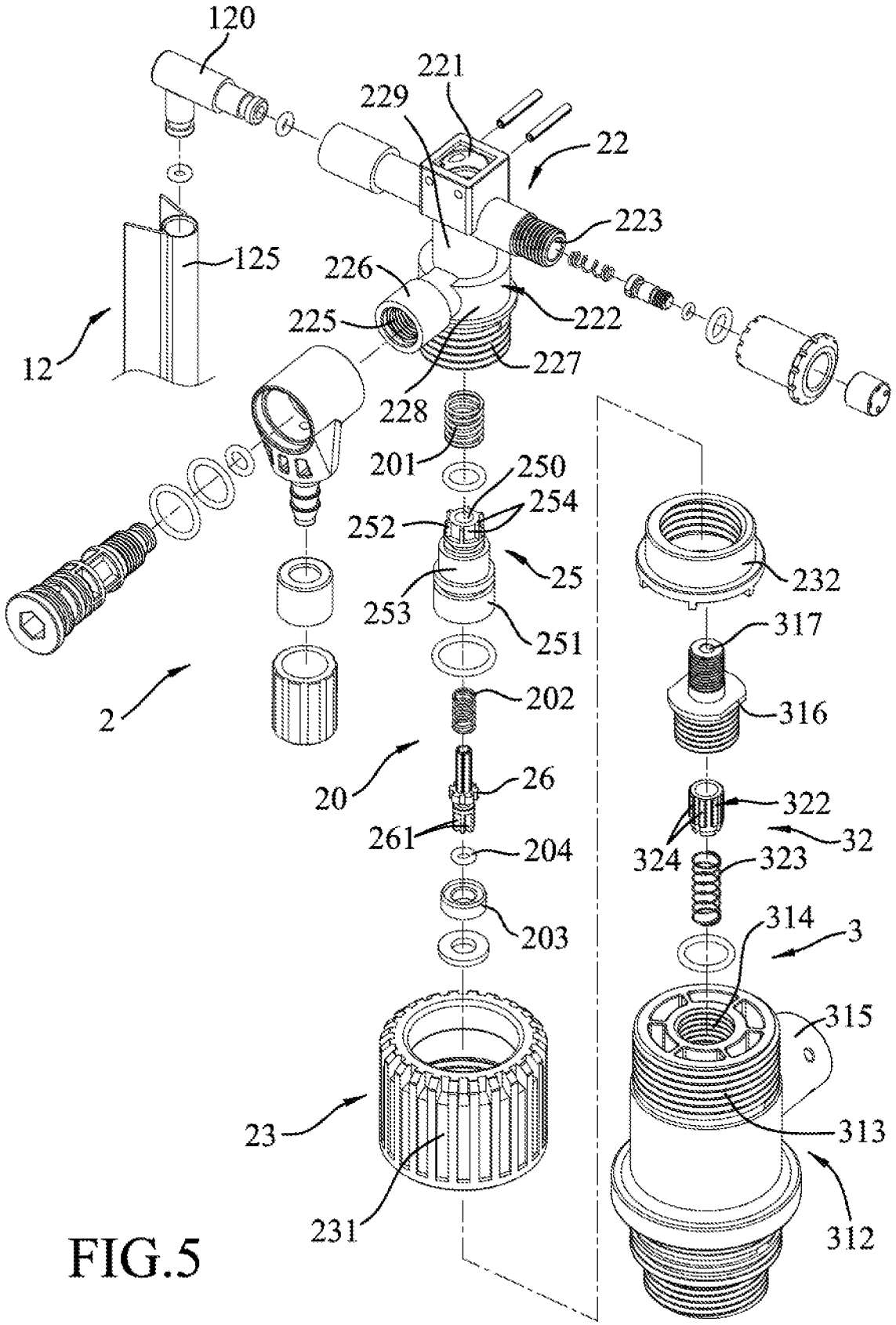
FIG. 5 is a fragmentary exploded perspective view illustrating a control mechanism and part of an air cylinder of the first embodiment.

The coupling ring unit 23 is coupled to the coupling segment 227 of the main tube 222 of the manifold seat 22. The coupling ring unit 23 includes a coupling ring 231 that permits the securing part 313 of the head component 312 of the cylinder body 31 of the air cylinder 3 to be removably coupled thereto, and a securing seat 232 that removably couples the coupling ring 231 to the coupling segment 227 of the main tube 222. In this embodiment, as shown in FIGS. 4 and 5, the coupling ring 231 and the securing part 313 of the head component 312 of the cylinder body 3 are respectively formed with an inner thread and an outer thread such that the cylinder body 31 can be coupled threadedly to the coupling ring 231, and the coupling segment 227 of the main tube 222 and the securing seat 232 are respectively formed with an outer thread and an inner thread such that the securing seat 232 is connected threadedly to the coupling segment 227. It should be noted that the configuration of the coupling ring unit 23 is not limited thereto, and may vary in other embodiments.

In this embodiment, the control unit 20 is mounted to the manifold seat 22 (e.g., in the main channel 221). The control unit 20 is convertible between an air-storing position (see FIG. 6), where air advanced from the linking unit 12 into the manifold seat 22 is limited to flow into the air channel 317, and the valve unit 32 is urged by pressure of the air to open so as to allow entrance of the air into the air-receiving space 310 of the air cylinder 3, and an air-pumping position (see FIG. 9), where air advanced from the linking unit 12 into the manifold seat 22 is limited to flow into the air tube unit 4 for output to inflate an object.

In this embodiment, the control unit 20 is automatically converted from the air-pumping position to the air-storing position when the air cylinder 3 is coupled to the manifold seat 22 of the control mechanism 2. In greater detail, the control unit 20 includes a first control valve 25 and a second control valve 26. The first control valve 25 is disposed in the main channel 221 of the main tube 222 of the manifold seat 22, is movable along the valve-moving axis 10', and has a surrounding wall 251 that defines a control channel 250 in fluid communication with the inlet channel 223 and the air channel 317. The surrounding wall 251 of the first control valve 25 has a guide portion 252 extending movably in the small diameter segment 229 of the main tube 222 of the manifold seat 22, and a block portion 253 extending movably in the large diameter segment 228 of the main tube 222 and for abutting against the shoulder 220 of the manifold seat 22. The guide portion 252 of the surrounding wall 251 has an outer surface formed with a plurality of spaced-apart first air vent passageways 254 for air passage. The second control valve 26 is disposed in the control channel 250, is movable along the valve-moving axis 10', and has an outer surface formed with a plurality of spaced-apart second air vent passageways 261 for air passage.

The control unit 20 further includes an outer seal ring 203, an inner seal ring 204, a first spring 201, and a second spring 202. The outer seal ring 203 is disposed in the control channel 250 of the first control valve 25 and located adjacent to a bottom end of the first control valve 25. The inner seal ring 204 is sleeved on and co-movable with the second control valve 26, and cooperates with the outer seal ring 203 to block the control channel 250 when the control unit 20 is at the air-pumping position. The first spring 201 is disposed for biasing the first control valve 25 downward toward the securing seat 232 of the coupling ring unit 23 so as to open the passage between the main channel 221 and the tube-connecting channel 225 of the manifold seat 22 when the control unit 20 is at the air-pumping position. The second spring 202 is disposed for biasing the second control valve 26 to move downward relative to the first control valve 25 so as to block the control channel 250 when the control unit 20 is at the air-pumping position.

The air tube unit 4 is connected to the second manifold tube 226 of the manifold seat 22, and is provided with an air tube 41 for outputting low pressure gas.

Referring to FIGS. 1, 4, and 6, when in use, the air cylinder 3 can be coupled to or separated from the control mechanism 2. When the air cylinder 3 is coupled to the control mechanism 2 (see FIGS. 4 and 6), the control unit 20 is converted to the air storing position, where the tip component 316 of the air cylinder 3 is inserted into the main channel 221 of the manifold seat 22 against biasing forces of the first and second springs 201, 202, so that the first and second control valves 25, 26 are pushed upward. At this time, a top of the block portion 253 of the first control valve 25 abuts against the shoulder 220 of the manifold seat 22 so that the air in the main channel 221 cannot flow into the tube-connecting channel 225, and the outer and inner seal rings 203, 204 are separated so that the air in the main channel 221 would flow into the air channel 317 of the tip component 316 of the air cylinder 3 through the control channel 250 and then eventually flow into the air-receiving space 310 of the container component 311 of the air cylinder 3 by the air flow pushing the valve member 322 downward. In other words, the tip component 316 of the cylinder body 31 pushes the first control valve 25 to block a passage between the main channel 221 and the tube-connecting channel 225 of the manifold seat 22, and the tip component 316 further pushes the second control valve 26 to open the control channel 250. At this time, the valve member 322 is urged by the pressure of the air in the manifold seat 22 to open the air channel 317 against a resilient force of the biasing spring 323. As a result, air generated by the air generating mechanism 1 cannot flow to the air tube unit 4, and can only flow into the air-receiving space 310 through the control channel 250 of the first control valve 25 for storage purpose.

Figure 8:
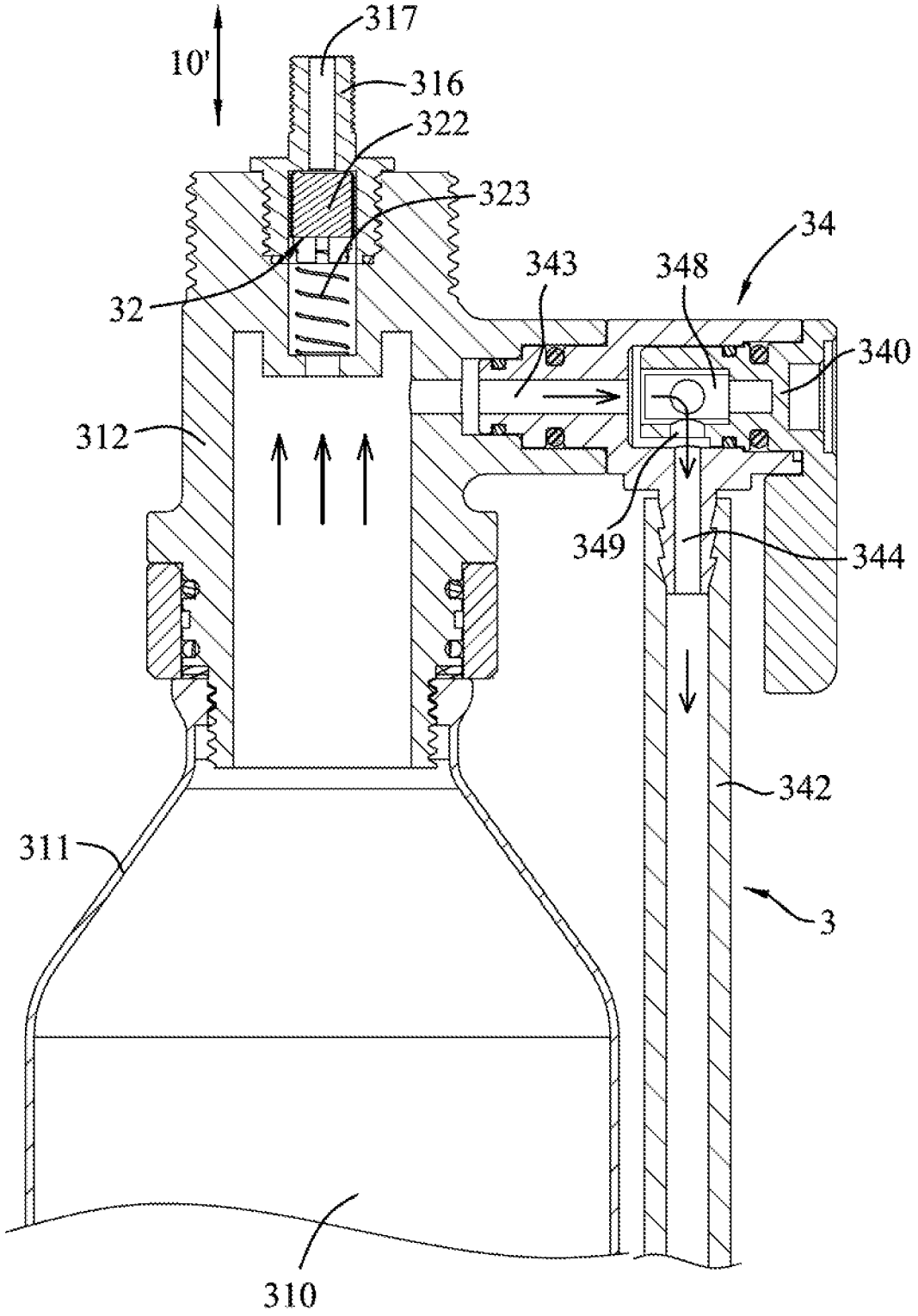
FIG. 8 is a fragmentary sectional view of the first embodiment, illustrating the air cylinder being used individually.
Figure 9:
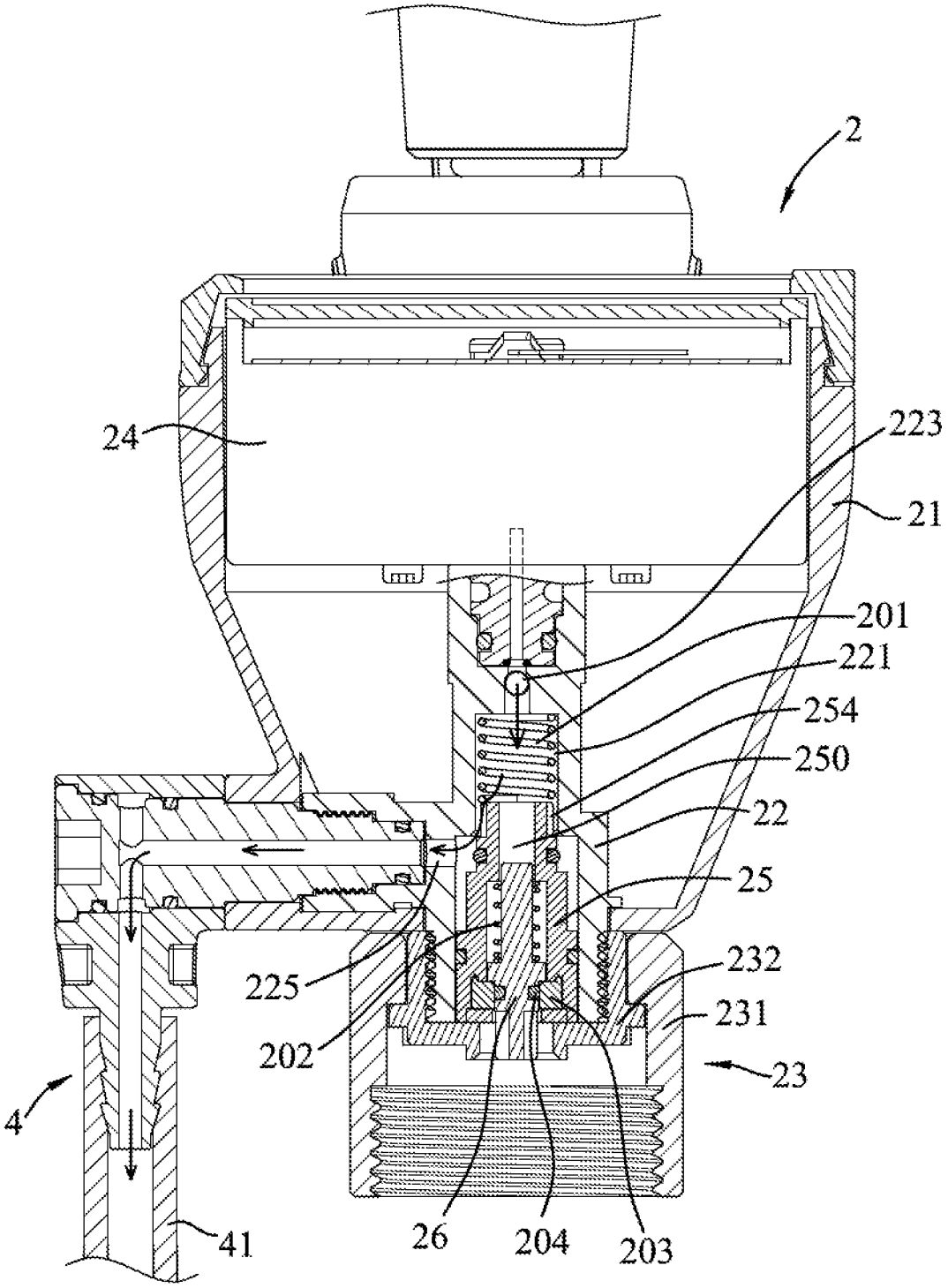
FIG. 9 is another fragmentary sectional view of the first embodiment, illustrating the control unit at an air-pumping position.

Referring to FIGS. 6, 8, and 9, after finishing storage, the air cylinder 3 and the control mechanism 2 can be separated and the control unit 20 can be converted to the air-pumping position simply by rotating the coupling ring 231, which generates the following actions:

1. Upon separation of the air cylinder 3 and the control mechanism 2, the biasing spring 323 of the valve unit 32 of the air cylinder 3 biases the valve member 322 upward so as to close the cylinder body 31 to prevent air leakage.

2. When the tip component 316 of the air cylinder 3 no longer pushes the control unit 20 upward, the second control valve 26 is moved downward by the basing force of the second spring 202 so that the outer and inner seal rings 203, 204 cooperatively block the control channel 250 to prevent leakage of air from the control channel 250.

3. The first spring 201 biases the first control valve 25 to move downward so that the block portion 253 of the first control valve 25 is separated from the shoulder 220 of the manifold seat 22 to open the passage between the main channel 221 and the tube-connecting channel 225, which allows the air generated by the air generating mechanism 1 to flow into the tube-connecting channel 225 through the main channel 221 and then be outputted by the air tube unit 4. It should be noted that since the air generated by the air generating mechanism 1 is substantially outputted by the air tube unit 4, the outputted air has a relatively low pressure.

To inflate an object with high pressure gas, the object is first connected to the output tube 342 of the outputting unit 34 of the air cylinder 3, and then the handle portion 347 of the operating member 340 is rotated so as to change the air cylinder 3 to an output position where the air stored in the air-receiving space 310 flows into the object through the first tube section 343 of the output valve seat 341, the output channel 348, the through hole 349, and the second tube section 344 of the output valve seat 341.

In summary, the air pump device of this disclosure is capable of providing both high pressure gas and low pressure gas, and the structure of the air pump device of this embodiment is cleverly designed such that the direction of the air flow can be altered simply by assembling or disassembling the air cylinder 3 onto the manifold seat 22 of the control mechanism 2. In addition, the air cylinder 3 can be easily disassembled from the manifold seat 22 for individual usage, and the air pump device without the air cylinder 3 can be operated individually as well.

Figure 10:
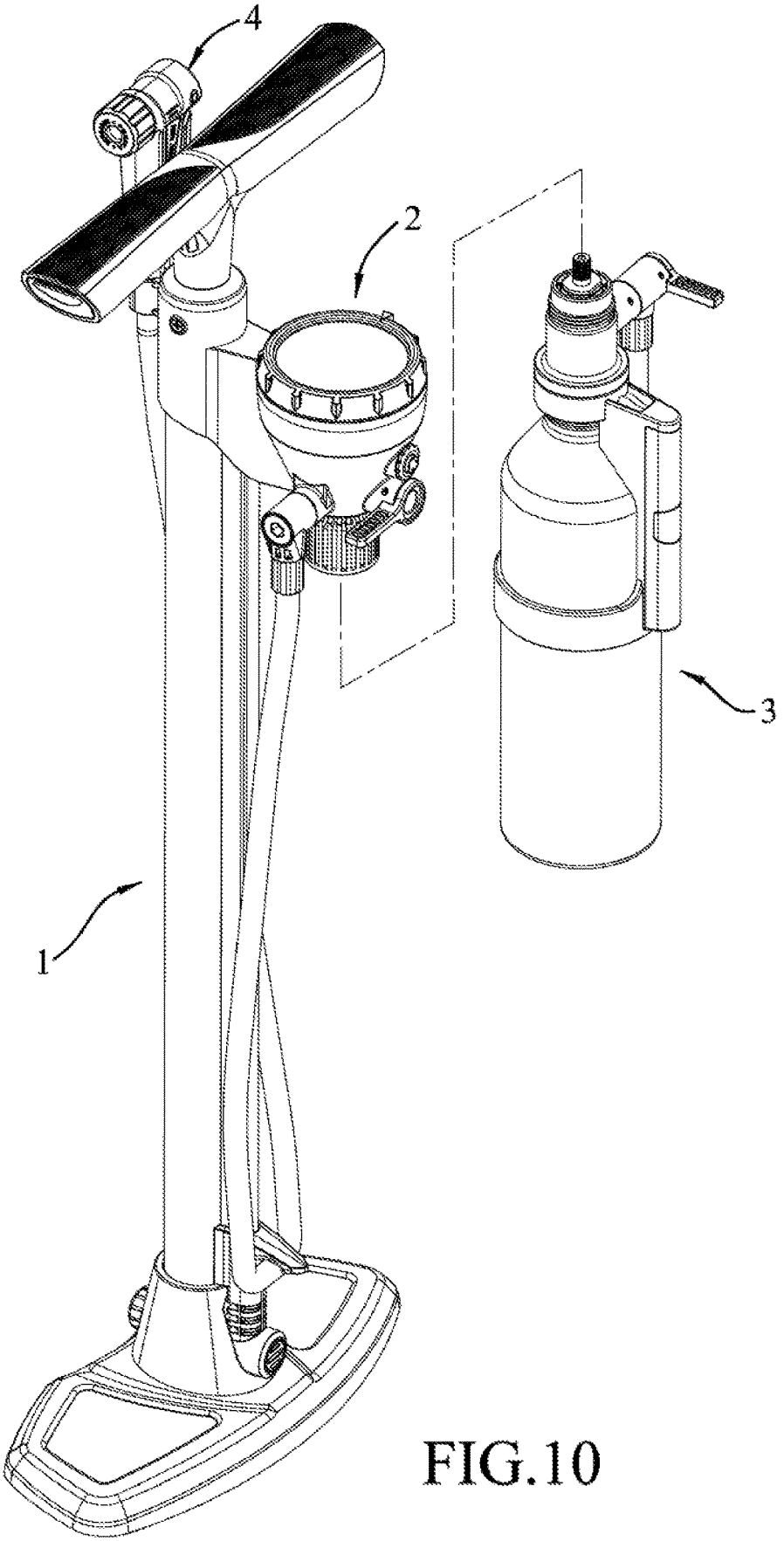
FIG. 10 is a partly exploded perspective view of a second embodiment of the air pump device according to the disclosure.
Figure 11:
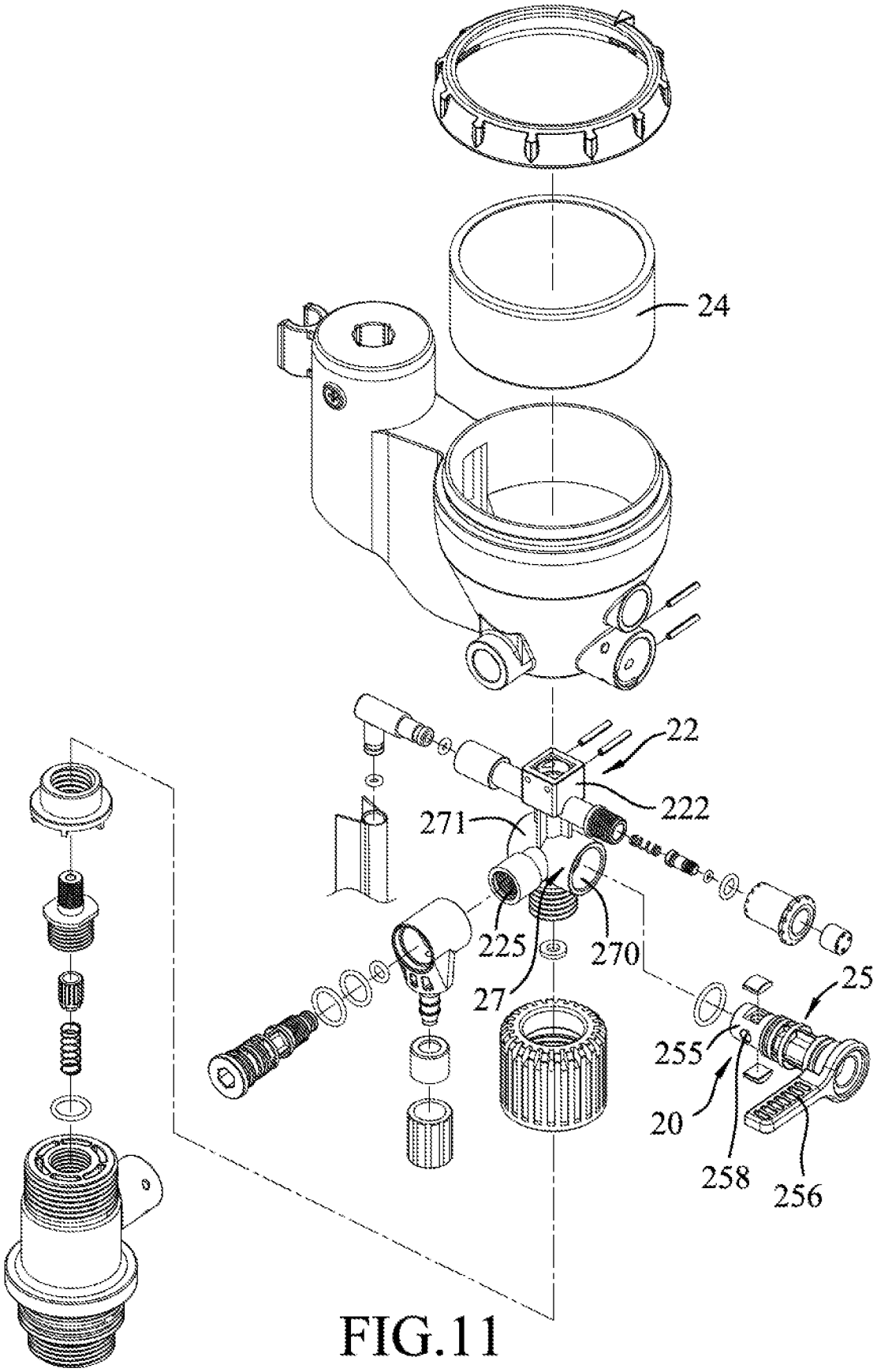
FIG. 11 is an exploded perspective view illustrating the control mechanism of the second embodiment.
Figure 12:
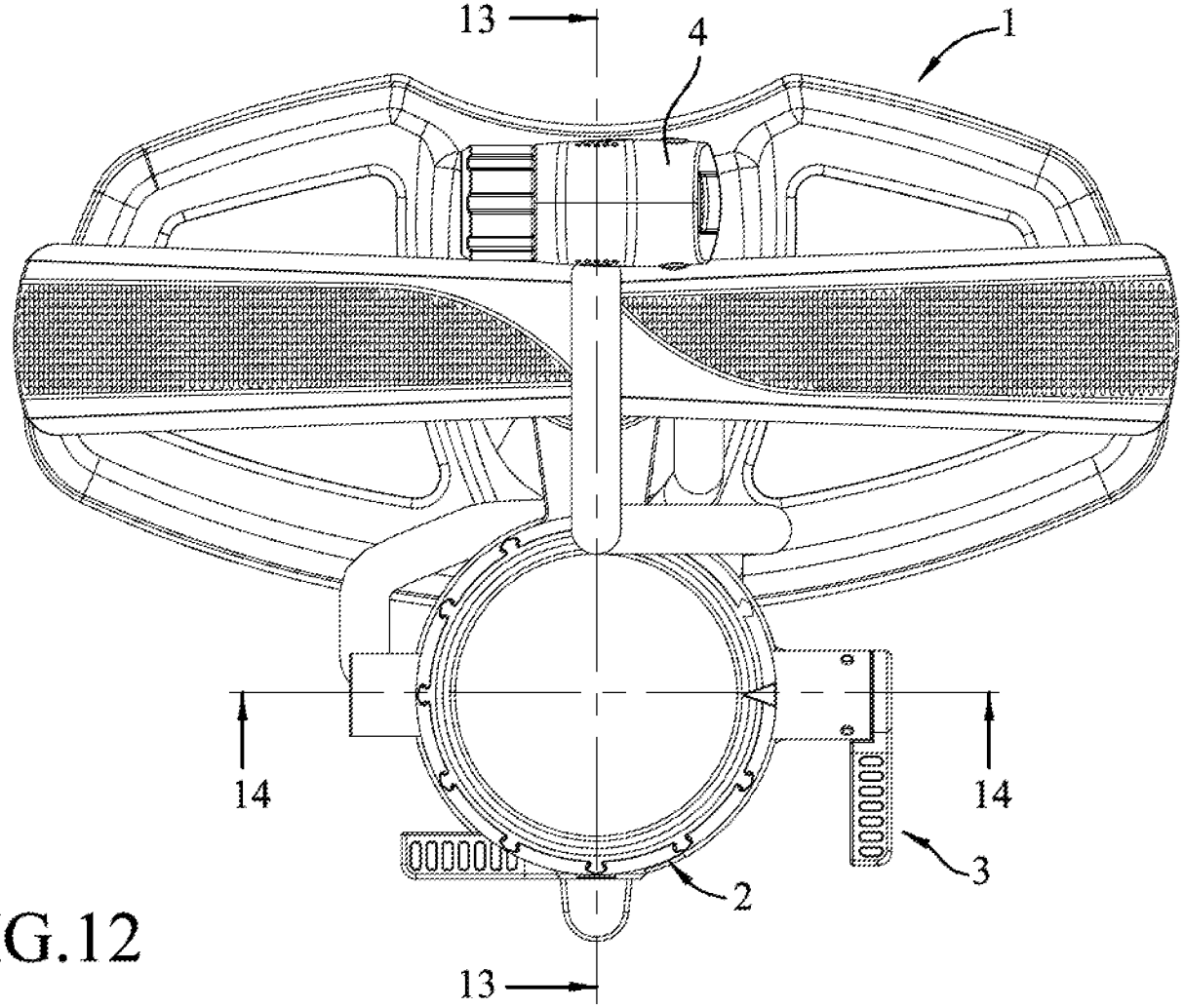
FIG. 12 is a top view of the second embodiment.

Referring to FIGS. 10 to 12, a second embodiment of the air pump device according to the disclosure is similar to the first embodiment. When the air cylinder 3 is assembled onto or disassembled from the manifold seat 22, the conversion of the control unit 20 between the air-storing position and the air-pumping position is carried out automatically in the first embodiment, and is carried out manually in the second embodiment. The first and second embodiments differ in the structure of the control mechanism 2.

Figure 13:
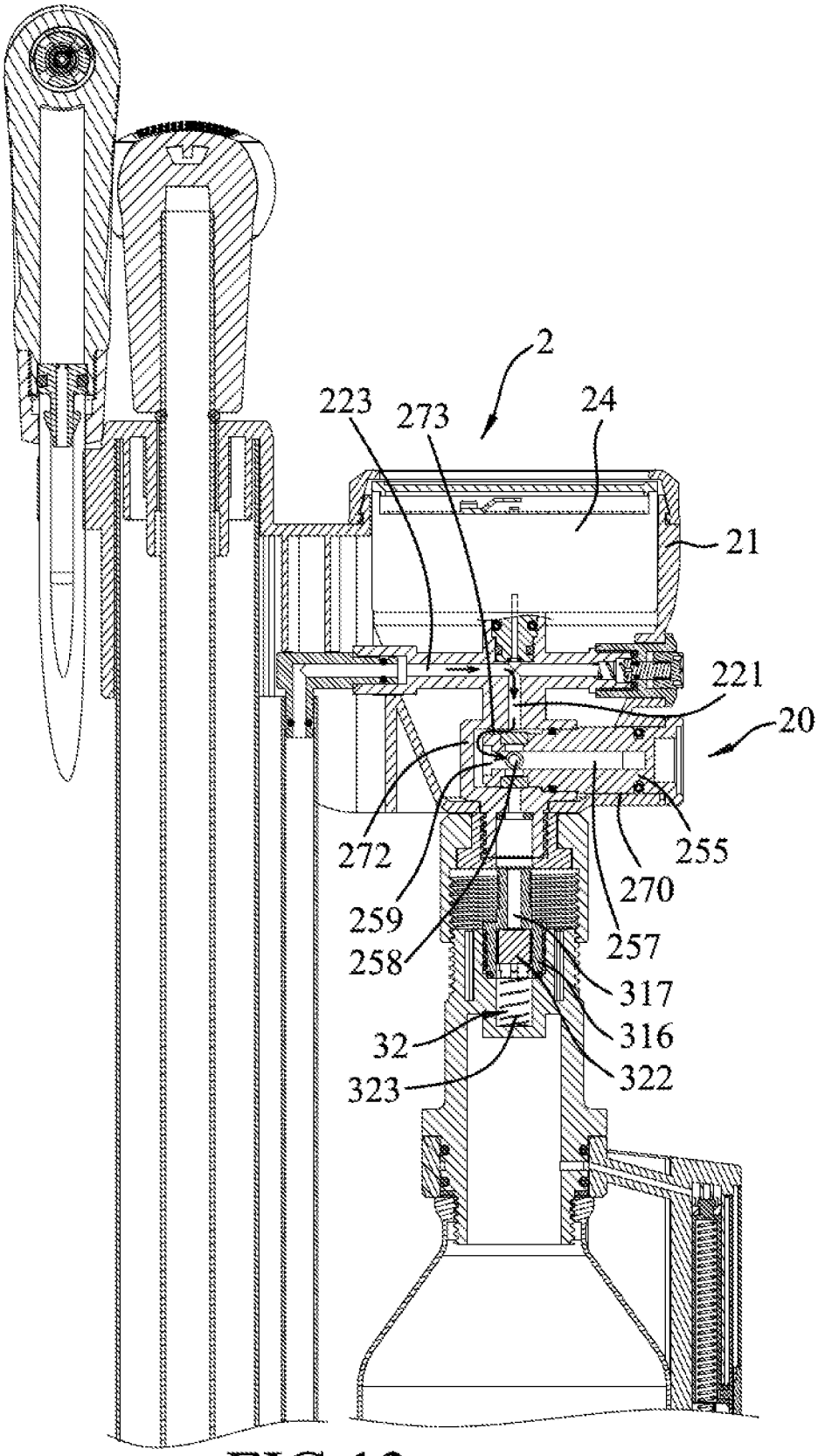
FIG. 13 is a fragmentary sectional view taken along line 13-13 in FIG. 12, illustrating the control unit of the second embodiment at the air-pumping position.
Figure 14:
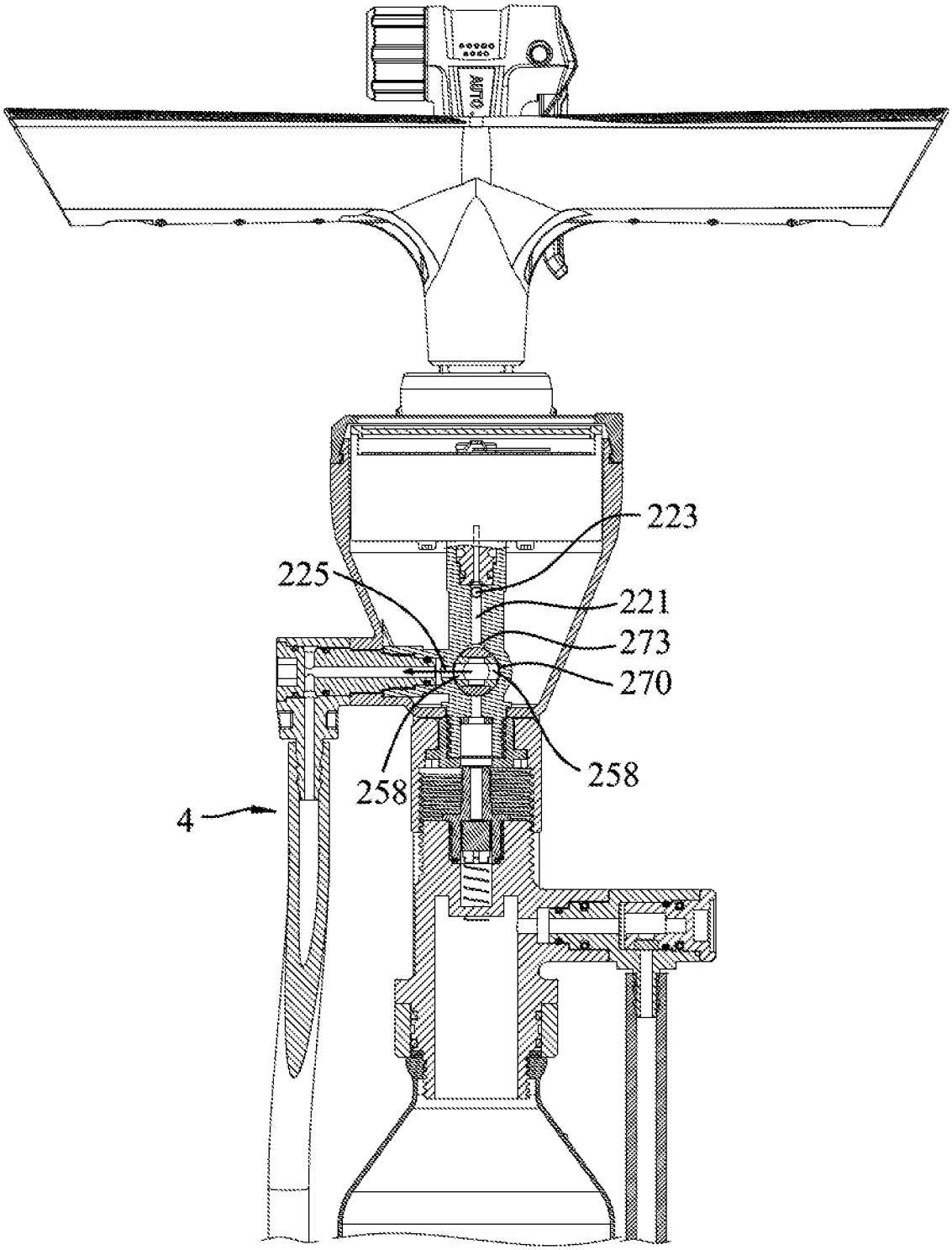
FIG. 14 is a fragmentary sectional view taken along line 14-14 in FIG. 12, illustrating the control unit of the second embodiment at the air-pumping position.

Referring to FIGS. 11, 13, and 14, in the second embodiment, the manifold seat 22 further has a connecting tube 27 that is perpendicular to the main tube 222, and that includes a tube wall 271 and an end wall 272. The tube wall 271 defines a valve-connecting channel 270 that is in fluid communication with the main channel 221 and the tube-connecting channel 225 of the manifold seat 22. The end wall 272 is connected to the tube wall 271 and closes an end of the valve-connecting channel 270. The valve-connecting channel 270 is parallel to the inlet channel 223 of the first manifold tube 224, and is perpendicular to the main channel 221.

In the second embodiment, the first control valve 25 of the control unit 20 has a valve body portion 255 extending rotatably into the valve-connecting channel 270, and a handle portion 256 connected to the valve body portion 255 and disposed outside of the valve-connecting channel 270 for access of a user. The valve body portion 255 defines an internal space 257 that has an open end 259 proximate to the end wall 272 of the connecting tube 27 of the manifold seat 22. The valve body portion 255 is formed with two vent holes 258 that are in fluid communication with the internal space 257. The tube wall 271 of the connecting tube 27 has a passage-defining wall portion 273 that cooperates with the valve body portion 255 of the first control valve 25 to define a passage therebetween.

A user can manually rotate the handle portion 256 of the first control valve 25 so as to convert the control unit 20 between the air-pumping position and the air-storing position. As shown in FIGS. 13 and 14, when the control unit 20 is at the air-pumping position, one of the vent holes 258 is registered with the tube-connecting channel 225, such that the air advanced from the linking unit 12 into the manifold seat 22 is limited to flow through the passage between the passage-defining wall portion 273 of the tube wall 271 and the valve body portion 255 of the first control valve 25 and flow into the internal space 257 of the valve body portion 255 via the open end 259 of the internal space 257, and then eventually flows into the tube-connecting channel 225 via the one of the vent holes 258 for output via the air tube unit 4.

Figure 15:
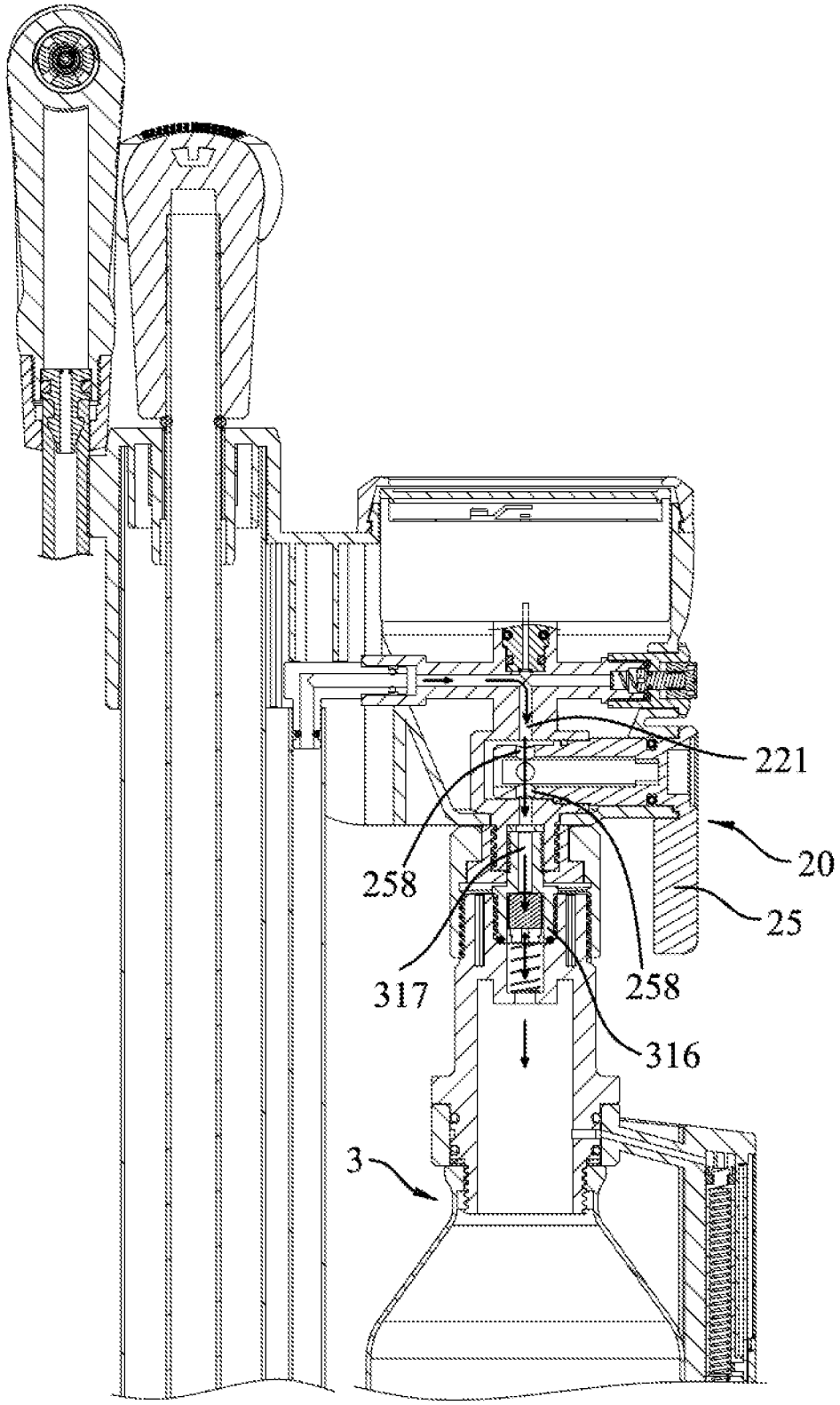
FIG. 15 is a view similar to FIG. 13, but illustrating the control unit of the second embodiment at the air-storing position.
Figure 16:
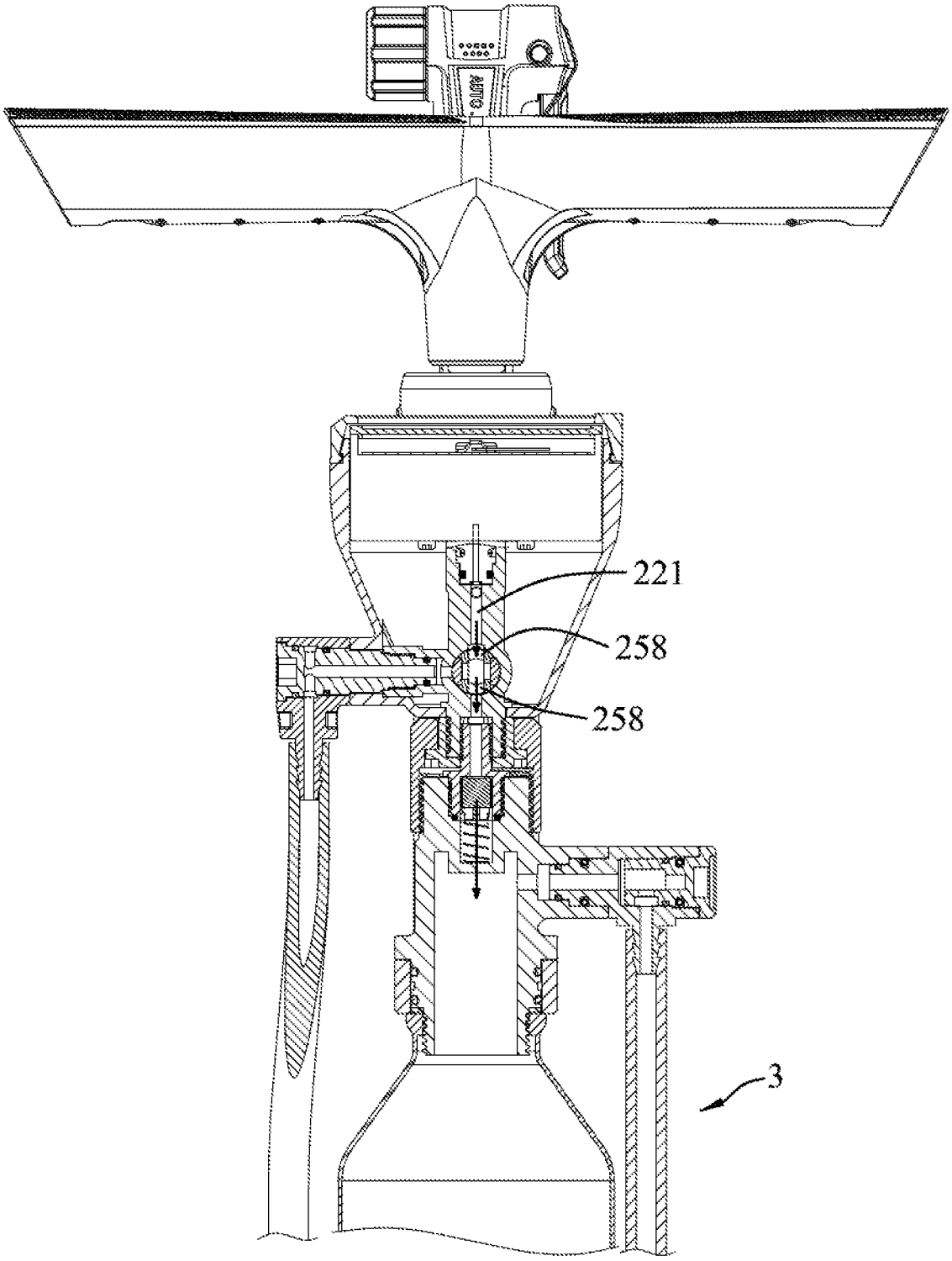
FIG. 16 is a view similar to FIG. 14, but illustrating the control unit of the second embodiment at the air-storing position.

As shown in FIGS. 15 and 16, when the control unit 20 is at the air-storing position, the vent holes 258 are in vertical alignment with the main channel 221, so that air can enter into the air cylinder 3 via the first control valve 25. That is, by simply rotating the handle portion 256 of the first control valve 25, the direction of the air flow can be changed.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An air pump device comprising:

an air generating mechanism including an air generating unit, and a linking unit connected to said air generating unit;

an air tube unit;

an air cylinder including:

a cylinder body that has an air-receiving space, and an air channel being in fluid communication with said air-receiving space, and a valve unit that is operable for opening and closing said air channel; and a control mechanism including:

a manifold seat that interconnects said linking unit of said air generating mechanism and said air tube unit, said air cylinder being removably connected to said manifold seat, and a control unit that is mounted to said manifold seat and that is convertible between an air-storing position, where air advanced from said linking unit into said manifold seat is limited to flow into said air channel, and said valve unit is urged by pressure of the air to open so as to allow entrance of the air into said air-receiving space of said air cylinder, and an air-pumping position, where air advanced from said linking unit into said manifold seat is limited to flow into said air tube unit for output to inflate an object;

wherein said manifold seat has a main tube that defines a main channel, and that has a coupling segment, an inlet channel that is connected between said main channel and said linking unit, and a tube-connecting channel that is connected between said main channel and said air tube unit; and wherein said control mechanism further includes a coupling ring unit that is coupled to said coupling segment of said main tube, said cylinder body of said air cylinder being coupled removably to said coupling ring unit.

2. The air pump device as claimed in claim 1, wherein:

said coupling ring unit includes:

a coupling ring, and a securing seat that couples removably said coupling ring to said coupling segment of said main tube of said manifold seat; and said cylinder body of said air cylinder includes:

a container component that defines said air-receiving space, and a head component that is connected to said container component, and that has a securing part coupled removably to said coupling ring of said coupling ring unit.

3. The air pump device as claimed in claim 2, wherein:

said cylinder body of said air cylinder further includes a tip component connected to said head component and defining said air channel; and said control unit of said control mechanism includes:

a first control valve disposed movably in said main channel of said main tube of said manifold seat, and defining a control channel that is in fluid communication with said inlet channel of said manifold seat and said air channel, and a second control valve disposed movably in said control channel;

when said control unit is at the air-storing position, said tip component of said cylinder body pushes said first control valve to block a passage between said main channel and said tube-connecting channel of said manifold seat, and said tip component further pushes said second control valve to open said control channel; and when said control unit is at the air-pumping position, said first control valve is moved to open said passage between said main channel and said tube-connecting channel, and said second control valve is moved to block said control channel.

4. The air pump device as claimed in claim 3, wherein said control unit further includes:

an outer seal ring that is disposed in said control channel of said first control valve; and an inner seal ring that is co-movable with said second control valve and that cooperates with said outer seal ring to block said control channel when said control unit is at the air-pumping position.

5. The air pump device as claimed in claim 3, wherein said control unit further includes:

a first spring that is disposed for biasing said first control valve toward said securing seat of said coupling ring unit so as to open said passage between said main channel and said tube-connecting channel of said manifold seat when said control unit is at the air-pumping position; and a second spring that is disposed for biasing said second control valve to move relative to said first control valve so as to block said control channel when said control unit is at the air-pumping position.

6. The air pump device as claimed in claim 3, wherein said valve unit of said air cylinder includes:

a valve member that is disposed movably in said air channel of said tip component of said cylinder body; and a biasing spring that is disposed for biasing said valve member to block said air channel, said valve member being urged by the pressure of the air in said manifold seat to open said air channel against a resilient force of said biasing spring when said control unit is at the air-storing position.

7. The air pump device as claimed in claim 2, wherein:

said manifold seat further has a connecting tube that includes:

a tube wall defining a valve-connecting channel that is in fluid communication with said main channel and said tube-connecting channel of said manifold seat, and an end wall connected said tube wall and closing an end of said valve-connecting channel;

said control unit includes a first control valve that has a valve body portion extending rotatably into said valve-connecting channel, said valve body portion defining an internal space that has an open end proximate to said end wall of said connecting tube of said manifold seat, said tube wall of said connecting tube having a passage-defining wall portion that cooperates with said valve body portion of said first control valve to define a passage therebetween, said valve body portion being formed with two vent holes that are in fluid communication with said internal space; and when said control unit is at the air-pumping position, one of said vent holes is registered with said tube-connecting channel, such that the air advanced from said linking unit into said manifold seat is limited to flow through said passage between said passage-defining wall portion of said tube wall and said valve body portion of said first control valve and flow into said internal space of said valve body portion via said open end of said internal space, and eventually flows into said tube-connecting channel via the one of said vent holes.

8. The air pump device as claimed in claim 7, wherein said valve unit of said air cylinder includes:

a valve member that is disposed movably in said air channel of said tip component of said cylinder body; and a biasing spring that is disposed for biasing said valve member to block said air channel, said valve member being urged by the pressure of the air in said manifold seat to open said air channel against a resilient force of said biasing spring when said control unit is at the air-storing position.

9. The air pump device as claimed in claim 7, wherein said first control valve further has a handle portion that is connected to said valve body portion and that is disposed outside of said valve-connecting channel for access of a user.

* * * * *